US006276540B1

(12) United States Patent
Skuro

(10) Patent No.: US 6,276,540 B1
(45) Date of Patent: Aug. 21, 2001

(54) SALES DISPLAY ORGANIZER FOR A PAIR OF GLOVES

(75) Inventor: John M. Skuro, Port Murray, NJ (US)

(73) Assignee: Gordini U.S.A. Incorporated, Essex Junction, VT (US)

( * ) Notice: Subject to any disclaimer, the term of this patent is extended or adjusted under 35 U.S.C. 154(b) by 0 days.

(21) Appl. No.: 09/541,638

(22) Filed: Apr. 3, 2000

(51) Int. Cl.[7] ..... A47F 7/00

(52) U.S. Cl. ..... 211/85.3; 211/113; 206/778; 206/278; 223/85

(58) Field of Search ..... 211/85.3, 113, 211/118; 223/78, 85; 206/278, 778

(56) References Cited

U.S. PATENT DOCUMENTS

D. 296,303 * 6/1988 Baptiste .
2,893,546 * 7/1959 Kendall et al. .
4,257,522 * 3/1981 Thorneburg .
4,852,783 * 8/1989 Bryden et al. .
5,014,957 * 5/1991 Nichol ..... 223/85 X
5,248,036 * 9/1993 Radocha et al. ..... 211/113 X
5,261,580 * 11/1993 Smith ..... 223/85
5,503,269 * 4/1996 DeBiasio .
5,522,499 * 6/1996 DeBiasio et al. ..... 206/278
5,553,706 * 9/1996 Gold ..... 206/296
5,743,403 * 4/1998 Crysdale ..... 211/113 X
5,893,459 * 4/1999 Croft ..... 206/778 X
5,988,373 * 11/1999 Yates ..... 211/113 X

* cited by examiner

*Primary Examiner*—Robert W. Gibson, Jr.
(74) *Attorney, Agent, or Firm*—John M. Brandt

(57) ABSTRACT

A sales display organizer for a pair of gloves linked by a flexible line having an attached tag consisting of a sleeve to hold one of the gloves and a transparent pocket mounted on the sleeve to hold the tag leaving the second glove free to be tried by a protective purchaser.

5 Claims, 2 Drawing Sheets

SALES DISPLAY ORGANIZER FOR A PAIR OF GLOVES

BACKGROUND OF THE INVENTION

1. Field of the Invention

The invention resides in the field of display devices for clothing and more particularly relates to a device for organizing a pair of gloves and attached tags.

2. Description of the Prior Art

Pairs of gloves of all kinds, both sport and dress, are most often displayed in stores attached to one another by a flexible line such as a nylon fishing line. They additionally have one or more information tags attached to the line. The tags show, For example, brand name, glove composition, and sales price.

Typically, the attached pairs are displayed for sale in an open space which allows prospective customers to rummage through the assorted offerings and try them for fit and appearance.

It is well known to store owners and sales clerks that such displays become disordered and entangled in short order. The attached gloves, lines, and tags intertwine requiring substantial and continuing effort to keep the display neat and attractive to prospective customers. Additionally as they are handled over a period of time, the tags become shop worn or separated entirely from their associated gloves leaving the gloves unmarked and essentially unsaleable.

The present invention is a sales display organizer designed to both protect display tags and reduce the intertwining described above while at the same time leaving one glove completely free to be tried on and the other available should the prospective customer wish to proceed after trying out the first.

SUMMARY OF THE INVENTION

The invention may be summarized as a sales display organizer for a pair of gloves consisting of a sleeve adapted to snuggly hold one the gloves having at least one transparent pocket affixed to the outer surface of the front or back of the sleeve. The invention is used to display gloves linked or ted together by a flexible line similar to the length of fish line as in common In the industry. The line not only keeps the gloves together as a pair but serves to hold an informational tag. The tag is secured by, for example, threading the line through a hole in one comer or by any other suitable means such as stapling over.

When one glove is inserted into the sleeve and the tag is inserted in the pocket, the other glove is free to be tried on and the entire package is relatively secure from entanglement with other such units.

When inserted in the pocket the tag helps to prevent the first glove from slipping out of the sleeve while leaving the second glove available for a trial fit.

Additional pockets may be provided to contain suitable information not included on the attached tag. Also, a clip may be added to further secure the first glove to the sleeve. If desired means to hang or suspend the organizer and gloves from a display rack can be included as well.

The features and advantages of the invention will be more fully understood from the description of the preferred embodiment and drawings which follows.

DESCRIPTION OF THE PREFERRED EMBODIMENT

Figure 1:
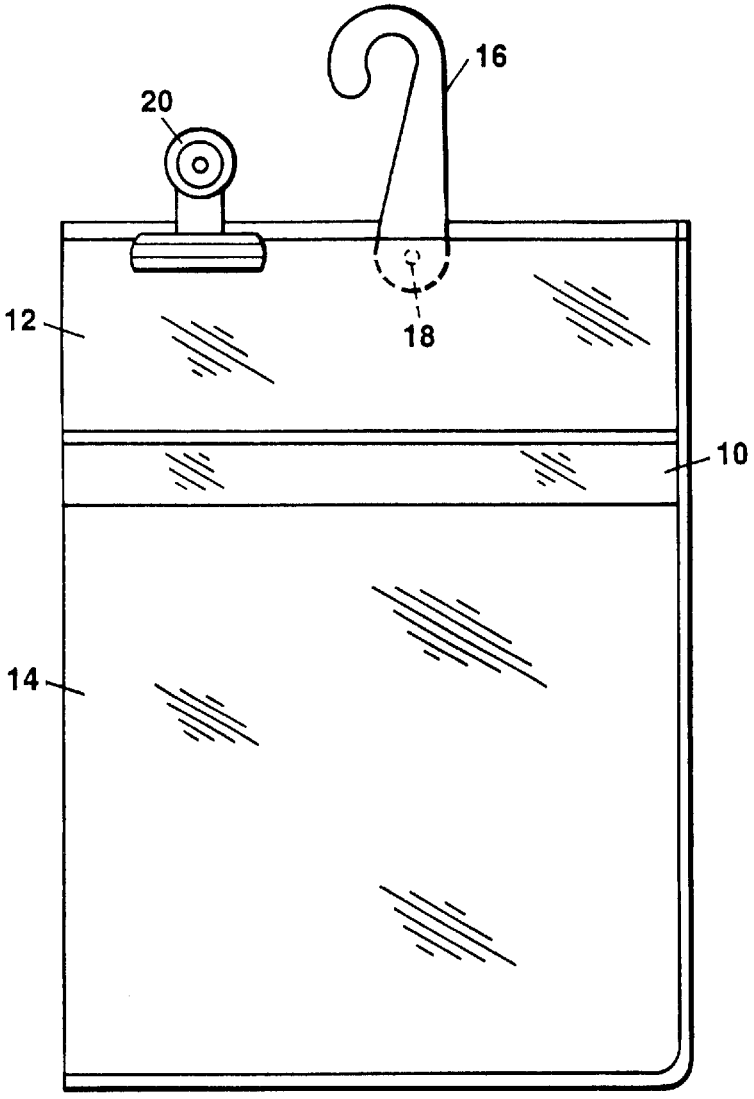
FIG. 1 is a plan view of the preferred embodiment of the invention.

Referring first to FIG. 1, a plan view of the preferred embodiment is illustrated consisting of sleeve 1 0, preferably composed of transparent sheet material, and transparent tag reviving pockets 12 and 14 mounted on the front face thereof. A hanging hook 16 is optionally attached to the rear face of sleeve 10 by, for example, rivet 18. Clip 20 may optionally be used to provide additional gripping means to further secure a glove within sleeve 10. The dip may or may not be permanently attached to sleeve 10 as desired.

Figure 2:
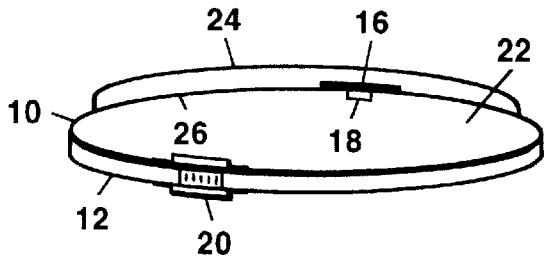
FIG. 2 is a top view of the embodiment of FIG. 1.
Figure 3:
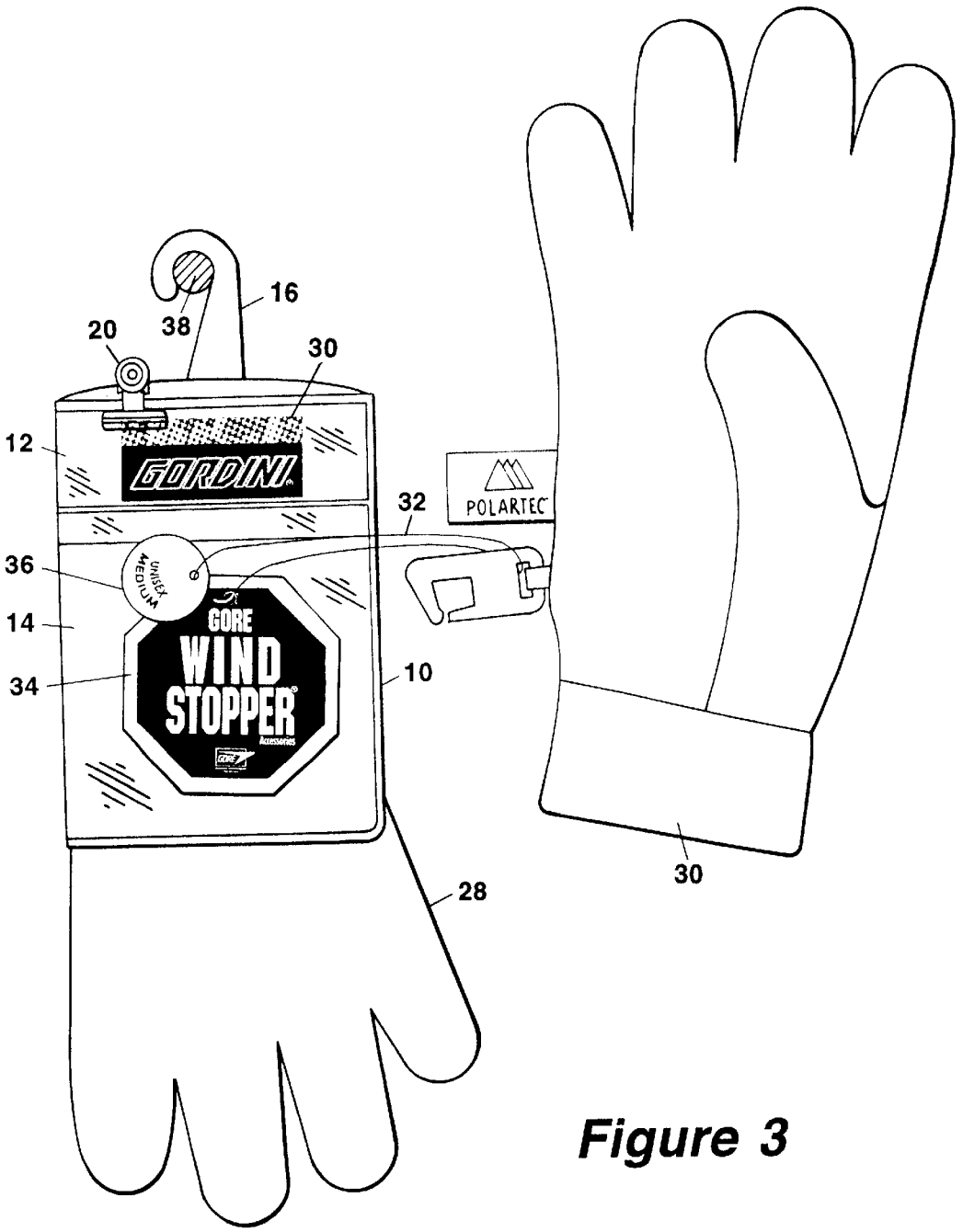
FIG. 3 is a plan view of the embodiment of FIG. 1 showing the invention in use.

FIG. 2 is a top view of the device of FIG. 1 showing sleeve opening 22 and an optional additional pocket 24 mounted on the rear face 26 of sleeve 10. FIG. 3 illustrates the use of invention to hold a pair of gloves 28 and 30 tied or linked by line 32 with appropriate tags 34 and 36. Glove 28 fits snuggly into sleeve 10 and tags 34 and 36 attached to line 32 into pocket 14. As will be seen, glove 30 is free to be tried on but will remain linked to glove 28 and pocket tags 34 and 36 by line 32. The entire package of sleeve and glove may be suspended from a display peg 38 using hook 16 and when so suspended, glove 30 will hang downwardly similarly to glove 28. Optionally clip 20 may be used to further secure glove 28 to sleeve 10 and may be attached directly to sleeve 10 or secured to line 32.

As variations in the above described preferred embodiment will occur to those skilled in the art, the invention is accordingly defined by the following claims:

What is claimed is:

1. A sales display organizer for a pair of gloves linked by a flexible line having an attached tag comprising in combination:

a. flexible sleeve adapted to receive and grip a first glove of said pair of gloves, said sleeve having front and back outer faces; and b. at least one flexible transparent pocket mounted on one of said faces for receiving said tag whereby when said first glove of said pair of gloves is inserted in said sleeve and said tag is inserted in said pocket, said first glove is held within said sleeve and the second glove of said pair of gloves is free to be tried by a prospective purchaser.

2. The apparatus of claim 1 including a clip to additionally secure said first glove in said sleeve.

3. The apparatus of claim 2 further including a flexible line linking said gloves and wherein said clip is attached to said flexible line.

4. The apparatus of claim 1 further including hanging means for hanging said organizer from a display rack.

5. The apparatus of claim 4 wherein said hanging means compromises a hook.

* * * * *